US007370907B2

(12) United States Patent
Leong

(10) Patent No.: US 7,370,907 B2
(45) Date of Patent: May 13, 2008

(54) RECONFIGURABLE FURNITURE

(76) Inventor: Michelle G. Leong, 1425 Western Ave., #111, Seattle, WA (US) 98101

( * ) Notice: Subject to any disclaimer, the term of this patent is extended or adjusted under 35 U.S.C. 154(b) by 655 days.

(21) Appl. No.: 10/718,364

(22) Filed: Nov. 20, 2003

(65) Prior Publication Data

US 2005/0121948 A1 Jun. 9, 2005

(51) Int. Cl.
*A47C 13/00* (2006.01)

(52) U.S. Cl. ..... 297/2; 297/118

(58) Field of Classification Search ..... 297/440.23, 297/1, 2, 3, 440.14, 118
See application file for complete search history.

(56) References Cited

U.S. PATENT DOCUMENTS 3,233,942 A * 2/1966 Creutz ..... 297/440.23
3,972,559 A * 8/1976 Anacker ..... 297/1 X
6,367,874 B2 * 4/2002 Casini ..... 297/3 X

* cited by examiner

*Primary Examiner*—Anthony D. Barfield

(57) ABSTRACT

A furniture system has a frame portion that may be set in one configuration to operate as a chair and can be readily reconfigured into a table. A frame portion provides support for an operating surface. In the table configuration, the frame is positioned in a first orientation with a working surface supported by the top of the frame. To change the configuration, the working surface is temporarily removed and the frame turned on its side (i.e., rotated 90°) such that a portion of the frame that was previously a leg now becomes part of the frame on the floor while a portion of the frame that was previously on the floor now becomes legs for a chair configuration. Following rotation of the frame, the working surface is reinstalled in a new orientation to complete the change and configuration.

21 Claims, 18 Drawing Sheets

RECONFIGURABLE FURNITURE

BACKGROUND OF THE INVENTION

1. Field of the Invention

The present invention is directed generally to and, more particularly, to reconfigurable furniture that serves multiple functions.

2. Description of the Related Art

The utilitarian function of furniture is unquestioned. Furniture is typically constructed in different physical arrangements to serve different utilitarian functions. In addition, furniture may have certain aesthetic aspects that work cooperatively with utilitarian functions. Other aesthetic aspects may serve no utilitarian function.

In certain situations, such as where space is limited, it may be desirable to have a piece of furniture function in multiple configurations to perform multiple tasks. One known device operates as a one-person seat or as a one-person work table. The seat back and seat bottom are formed of a unitary piece of material or formed as separate components that are bolted together. When used as a single-person chair configuration, the seat back/bottom attaches to a two-piece frame at pre-determined points. For operation as a one-person work table, the seat back/bottom is reversed and attached to the two-piece frame to function as a table.

Unfortunately, the drawback of this device is the lack of strengthening and rigidity in the frame, which limits the width of the chair and its ability to support the weight of one or more individuals.

Therefore, it can be appreciated that there is a need for a device that allows reconfiguration of furniture to operate in multiple functional modes. The present invention provides this, and other advantages as will be apparent from the following detailed description and accompanying figures.

BRIEF SUMMARY OF THE INVENTION

A reconfigurable furniture system comprises first and second opposing side-frame portions with each of the side frame portions having first and second sets of side frame members. The first set of side frame members provides vertical support when the furniture system is placed in a first configuration and the second set of frame members provides vertical support when the furniture system is placed in a second configuration.

The furniture system further comprises first and second support members coupled to the first and second side frame portions with the first and second support members defining a plane that is vertically oriented when the furniture system is placed in the first configuration and horizontally oriented when the furniture system is placed in the second configuration. First and second cross members are also coupled to the first and second side frame portions at a location spaced apart from the first and second support members. The furniture system further comprises an operating surface member resting on and supported by the first and second cross members when the furniture system is placed in the first configuration. The operating surface member rests on and is supported by the first and second support members when the furniture system is placed in the second configuration.

In an exemplary embodiment, the first configuration is a seat configuration in which the operating surface member is resting on and supported by the first and second cross members to function as a seat bottom. The system may further comprise an additional operating surface member being positions proximate to and supported by the first operating surface member and the first support member to function as a seat back when the furniture system is in the first configuration.

The system may further comprise a retaining member on the first operating surface member to receive and releasibly retain the second operating surface member. In one embodiment, the retaining member may comprise a channel having sufficient width and depth to receive and releasibly retain the second operating surface member.

In the second configuration, the system is in a table configuration and the operating surface member is resting on and supported by the first and second support members to function as a table top when the furniture system is placed in the second configuration.

In one embodiment, the frame portions may be made from metal and may be coupled together by welding. In an alternative embodiment, the frame portion components may be removably coupled together. In one embodiment, the components of the frame portion may be coupled together by bolts.

BRIEF DESCRIPTION OF THE SEVERAL VIEWS OF THE DRAWING(S)

DETAILED DESCRIPTION OF THE INVENTION

Figure 1:
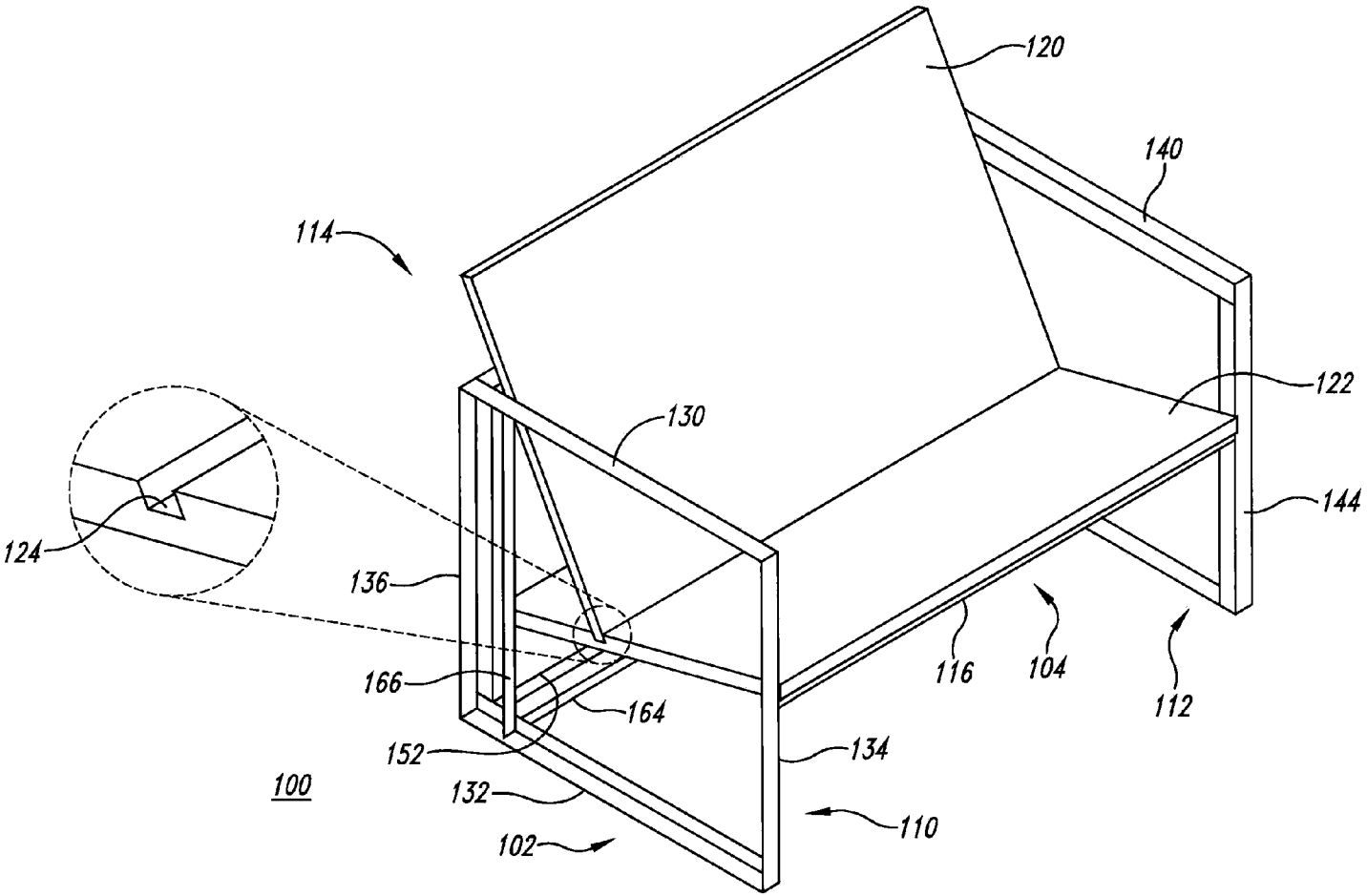
FIG. 1 is a perspective view of the inventive device in a chair configuration.
Figure 2:
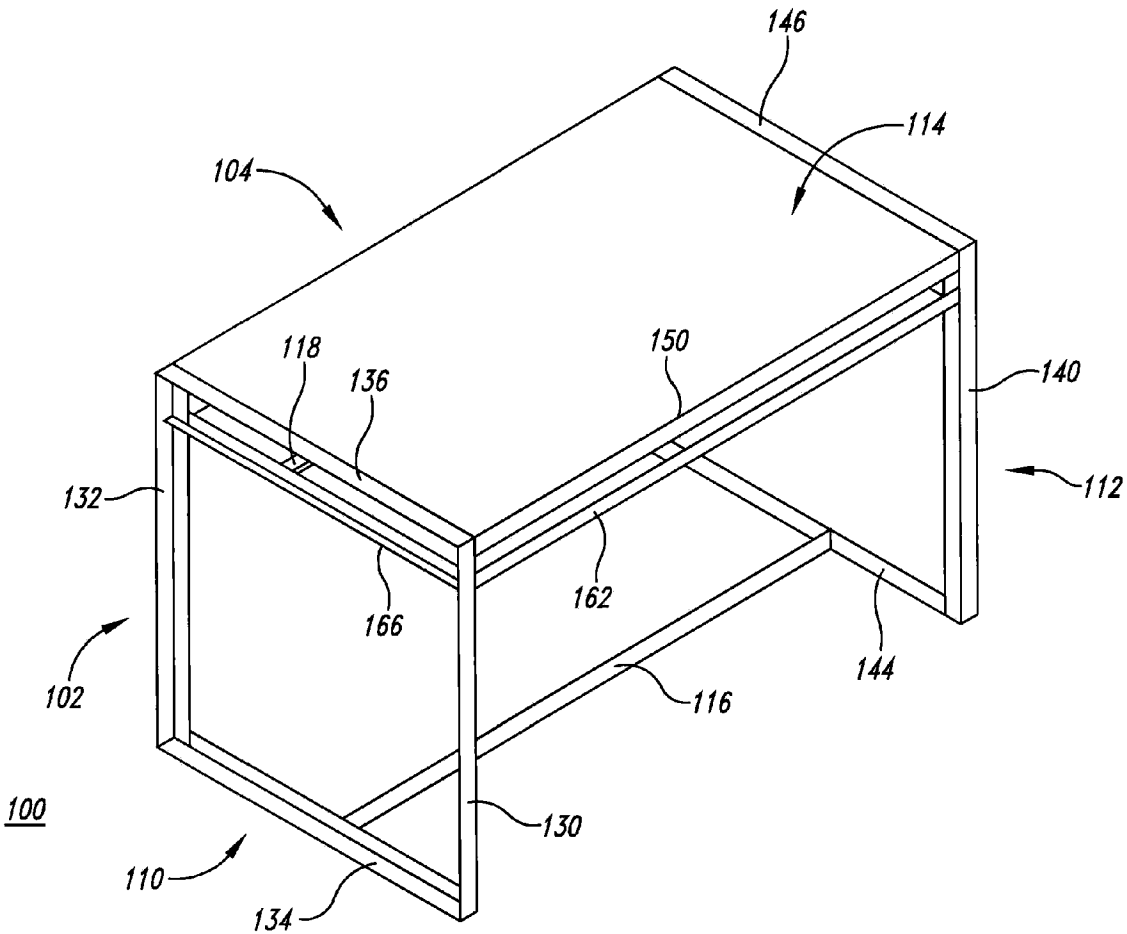
FIG. 2 is a perspective view of the device of FIG. 1 in a table configuration.

As will be described in greater detail herein, the present invention is directed to reconfigurable furniture that may be readily inter-converted between a chair configuration and a table configuration. The various figures are directed to a furniture system 100 comprising a frame portion 102 and a working surface portion 104. The furniture system 100 is illustrated in FIG. 1 in a chair configuration. In FIG. 1, the frame portion 102 comprises left and right side portions 110 and 112, respectively. The frame portion 102 also includes an inter-connecting frame portion 114 that couples the left and right-side portions 110 and 112 together. The frame portion 102 also includes cross members 116 and 118, which may be seen in FIG. 2. As will be described in greater detail below, the cross members 116 and 118 provide strength and rigidity to the frame portion 102 and also serve as supports for the working surface portion 104 in the chair configuration of FIG. 1.

The working surface portion 104 comprises a seat back 120 and seat bottom 122. As will be described in greater detail, the seat bottom 122 is supported by the cross members 116 and 118 when the furniture system 100 is in the chair configuration. Also while in the chair configuration, the seat back 120 is supported by the seat bottom 122 and the interconnecting frame portion 114.

In the table configuration of the furniture system 100, the seat back 120, seat bottom 122, or both, are placed within and supported by the left and right side portions 110 and 112 and the interconnecting frame portion 114.

Figure 3:
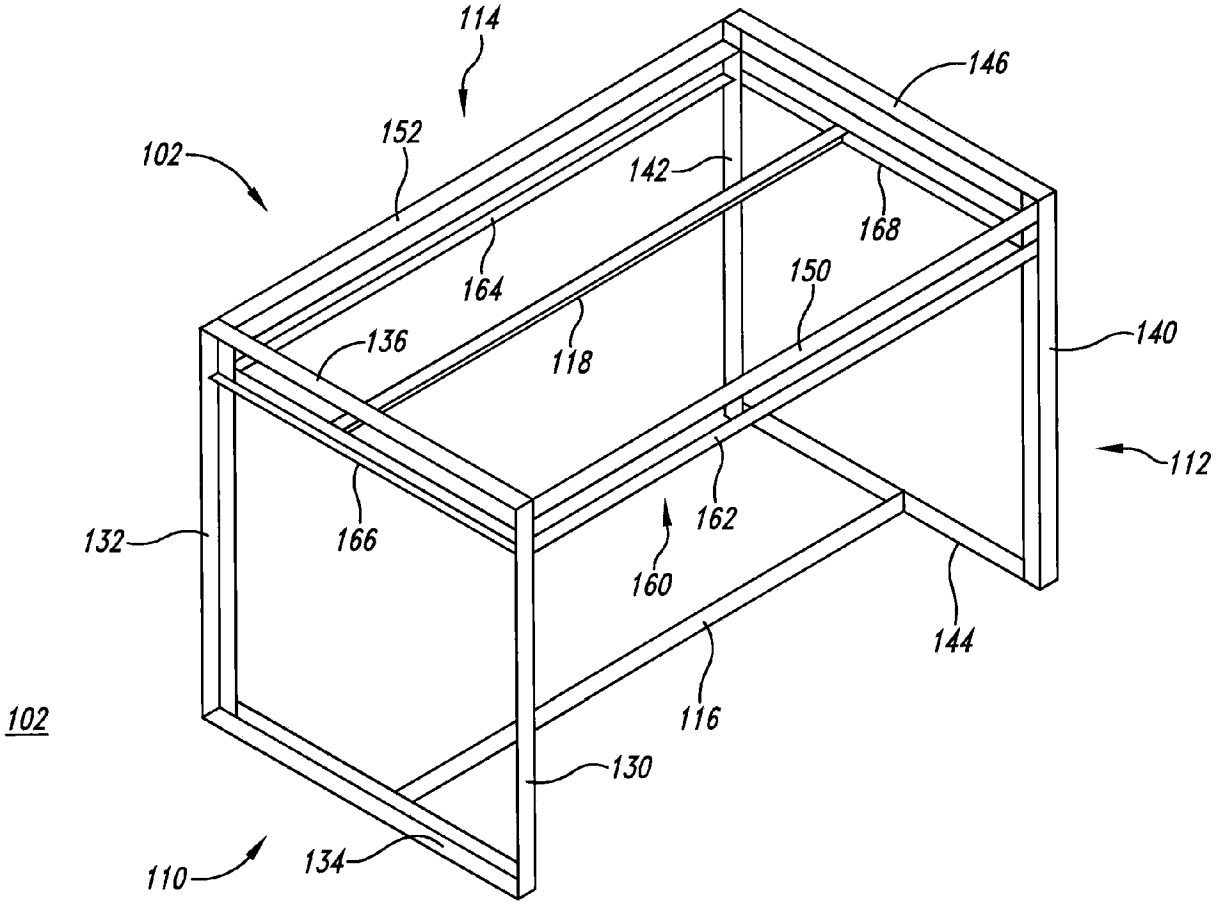
FIG. 3 is a perspective view of the frame of the device of FIG. 2 with the working surface removed.

FIG. 3 illustrates the furniture system 100 in the table configuration with the working surface portion 104 (see FIGS. 1-2) removed to better illustrate the frame construction.

In an exemplary embodiment, the frame portion 102 is manufactured with steel components to provide the desired strength and rigidity. In one embodiment, the frame portion 102 may be manufactured from steel angle brackets, as best seen in FIGS. 8-12. As those skilled in the art can appreciate, angled brackets provide greater rigidity than flat steel components.

Alternatively, the frame portion 102 may be manufactured with hollow steel tubing to provide the necessary structural strength and rigidity, but in a more decorative form. The hollow steel tubing may be in the form of circular tubing, rectangular tubing, or the like. The selection of a specific shape for the tubing used to form the frame portion 102 is within the skill of a furniture designer. The present invention is not limited by the specific form of metal components used to manufacture the frame portion 102. Other decorative elements, such as chrome finish, paint, or the like may be applied to the frame portion 102 to provide the desired aesthetic qualities.

In yet another alternative embodiment, the frame portion 102 may be manufactured with other known construction materials, such as wood, plastic, composite materials, and the like. The present invention is not limited by the specific materials used to form the frame portion 102.

Similarly, the working surface portion 104 may be readily manufactured using wood. The seat back 120 and seat bottom 122 may be formed with solid wood, or veneer applied over a substrate material. The thickness of the wood is selected to provide the necessary strength and rigidity. This is particularly important in the chair configuration where the furniture system 100 must support the weight of one or more individuals. In contrast, the working surface portion 104 typically supports less weight in the table configuration.

Alternatively, the working surface portion 104 may be manufactured using other known materials, such as metal, plastic, composites, stone, or the like. The present invention is not limited by the selection of materials used to form the working surface portion 104.

FIG. 1 also illustrates a channel 124 having sufficient size and depth to receive and removably retain the seat back 120. In the chair configuration, the seat back 120 fits into the channel 124, but can be easily removed for conversion of the furniture system 100 to the table configuration. Alternative techniques for retaining the seat back 120 in the proper position are discussed below.

Returning again to FIG. 3, the left-side portion 110 comprises first and second opposing pieces 130 and 132. In the table configuration, the first and second pieces 130 and 132 form two legs of the furniture system 100.

A third piece 134 inter-connects the first and second pieces 130 and 132 at a first end thereof. A fourth piece 136 inter-connects the first and second pieces 130 and 132 at a second end thereof. Thus, the first through fourth pieces 130-136 form the left-side portion 110 in a roughly rectangular configuration.

The right-side portion 112 is similarly formed with first, second, third and fourth pieces 140-146, respectively. The first and second pieces 140 and 142 are arranged parallel to each other and form the right-side legs of the furniture system 100 when in the table configuration. The first and second pieces 140-142 are inter-connected at a first end by the third piece 144 and at a second end of the first and second pieces by the fourth piece 146. Thus, the first through fourth pieces 140-146 form the right-side portion 112 in a substantially rectangular arrangement.

The left-side portion 110 is coupled to the right-side portion 112 by the inter-connecting frame portion 114. The inter-connecting frame portion 114 comprises a first support member 150 and a second support member 152. In an exemplary embodiment, the first support member 150 is coupled to the first piece 130 of the left-side portion 110 and the first piece 140 of the right-side portion 112. Similarly, the second support member 152 is coupled to the second piece 132 of the left side portion 110 and the second piece 142 of the right-side portion 112.

The cross member 116 also couples together the left-side portion 110 and right-side portion 112. The cross member 116 is coupled to the third piece 134 at substantially its mid point. The cross member 116 is also coupled to the third piece 144 of the right-side portion 112 at substantially the mid point of the third piece.

In an exemplary embodiment of the furniture system 100, an additional structure is provided in the form of a support bracket 160. The support bracket 160 comprises a first support bracket member 162 and a second support bracket member 164. The first support bracket member 162 is substantially parallel to the first support member 150 and spaced apart a short distance therefrom. The first support bracket member 162 also couples together the first piece 130 of the left-side portion 110 and the first piece 140 of the right-side portion 112.

Similarly, the second support bracket member 164 is substantially parallel to the second support member 152 and spaced apart a short distance therefrom. The second support bracket member 164 also couples together the second piece 132 of the left-side portion 110 and the second piece 142 of the right-side portion 112.

A third support bracket member 166 is substantially parallel to the fourth piece 136 of the left-side portion 110 and is spaced apart a short distance therefrom. The third support bracket member 166 is coupled between the first and second pieces 130 and 132 of the left-side portion 110.

Similarly, a fourth support bracket member 168 is substantially parallel to the fourth piece 146 of the right-side portion 112 and spaced apart a short distance therefrom. The fourth support bracket member 168 is coupled between the first and second pieces 140-142 of the right-side portion 112.

The cross member 118 is coupled between the third support bracket member 166 and the fourth support bracket member 168. Thus, the various components used to form the frame portion 102 provide strength and rigidity in both the chair configuration and the table configuration.

The first through fourth support bracket members 162-168 provide additional structural strength and rigidity and further provide aesthetic appeal in the design of the furniture system 100. In an alternative embodiment, an additional cross member (not shown) may be connected to the third and fourth support bracket members parallel to and spaced apart from the cross member 118. In this embodiment, either the seat back 120 or the seat bottom 122 may be stored when the furniture system 100 is used in the table configuration. The seat bottom 122 (or seat back 120) is stored by placing the selected part of the working surface portion 104 on the cross members coupled to the support bracket members. The remaining part of the working surface portion 104 is placed on top of and is supported by the fourth piece 136 of the left-side portion 110, the fourth piece 146 of the right-side portion 112 and the first and second support members 150-152. The stored working surface portion 104 supported by the cross member 118 and the additional cross-member (not shown) may be conveniently used as a storage shelf while the furniture system 100 is used in the table configuration.

Figure 4:
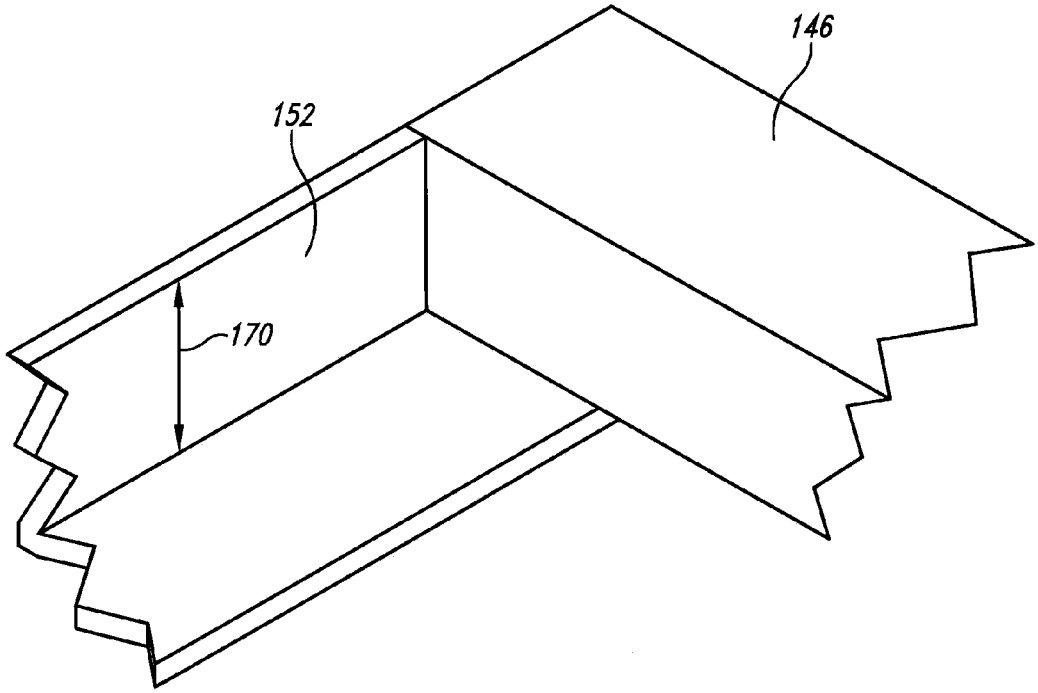
FIG. 4 is a fragmentary view of bracket construction.

In an alternative embodiment, the combined thickness of the seat back 120 and the seat bottom 122 are approximately equal to the height of the angle brackets used to construct the fourth piece 136 of the left-side portion 110, the fourth piece 146 of the right-side portion 112 and the first and second members 150-152. This embodiment is illustrated in the fragmentary view of FIG. 4 where a vertical dimension 170 of the fourth piece 146 of the right-side portion 112 and the second support member 152 is approximately equal to the combined thickness of the seat back 120 and seat bottom 122. In an embodiment wherein either the seat back 120 or the seat bottom 122 is stored and supported by the cross member 118 and the additional cross member (not shown), the vertical dimension 170 may be altered to equal the thickness of the part of the working surface portion (i.e., either the seat back 120 or the seat bottom 122) used to form the working surface when the furniture system 100 is used in the table configuration.

Those skilled in the art will appreciate that the dimensions of the frame portion 102 may be varied to accommodate the specific needs of the user. However, it may be desirable to construct the frame portion 102 with dimensions that are suitable for their purpose. Accordingly, in an exemplary embodiment, the first and second pieces 130 and 132 of the left-side portion 110 and the first and second pieces 140 and 142 of the right-side portion 112 are approximately 30 inches in length. When operating in the table configuration (see FIG. 2) the working surface portion 104 is positioned at a conventional height for use as a table.

Conversely, when the frame portion 102 is rotated into the chair configuration (see FIG. 1), the third and fourth pieces 134 and 136 of the left-side portion 110 together with the third and fourth pieces 144-146 of the right-side portion 112 established the height of the furniture system in the chair configuration. In an exemplary embodiment, the length of the third and fourth pieces 134-136 of the left-side portion 110 and the third and fourth pieces 144-146 of the right-side portion 112 are set at approximately 28 inches. This length is selected to provide a desirable height for an armrest for operation in the chair configuration. The first and second support members 150 and 152 are selected to provide an overall length of 4' for the furniture system 100. Although specific dimensions have been provided herein for guidance, those skilled in the art will appreciate that the dimensions can be easily varied without adverse impact on the functionality of the furniture system 100. Accordingly, the furniture system 100 is not limited by the specific dimensions described herein.

Figure 5:
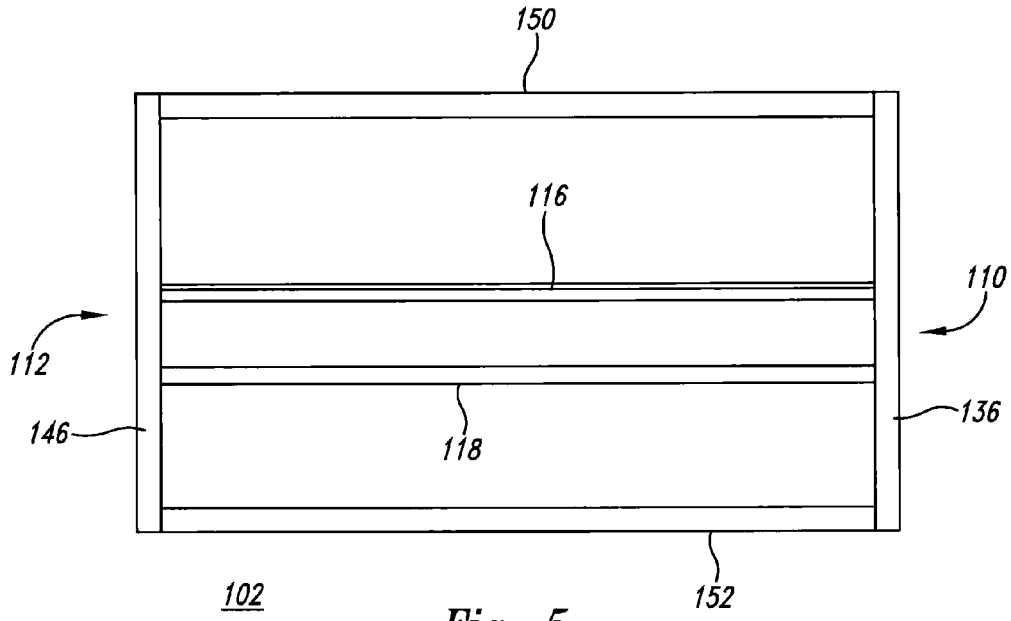
FIG. 5 is a top view of the frame of FIG. 3.

FIG. 5 is a top plan view of the frame portion 102 when the furniture system 100 is in the table configuration. The offset of the cross members 116 and 118 may be readily seen in FIG. 5. This offset is used to determine the angle at which the seat bottom 122 is positioned when the furniture system 100 is used in the chair configuration. The furniture system 100 is altered between the chair configuration (see FIG. 1) and the table configuration (see FIG. 2) by temporarily removing the working surface portion 114 and rotating the frame portion 102 to the desired configuration. If rotated to the table configuration, the seat back 120 and seat bottom 122 may be positioned in the matter described above. When rotated to the chair configuration, as illustrated in FIG. 1, the seat bottom 122 is mounted on and supported by the cross members 116 and 118. The offset in the cross members illustrated in FIG. 5 sets the angle at which the seat bottom 122 will be positioned. Although the seat bottom may be positioned at any convenient angle, the offset in the cross members 116-118 is selected to provide an angle of approximately 13 degrees between the seat bottom 122 and the floor. The minimum usable angle is approximately 0° (i.e., the seat bottom 122 is substantially parallel to the floor). The maximum usable angle is approximately 20°. However, those skilled in the art will recognize that an appropriate comfort range may be readily selected for the seat bottom 122.

Figure 6:
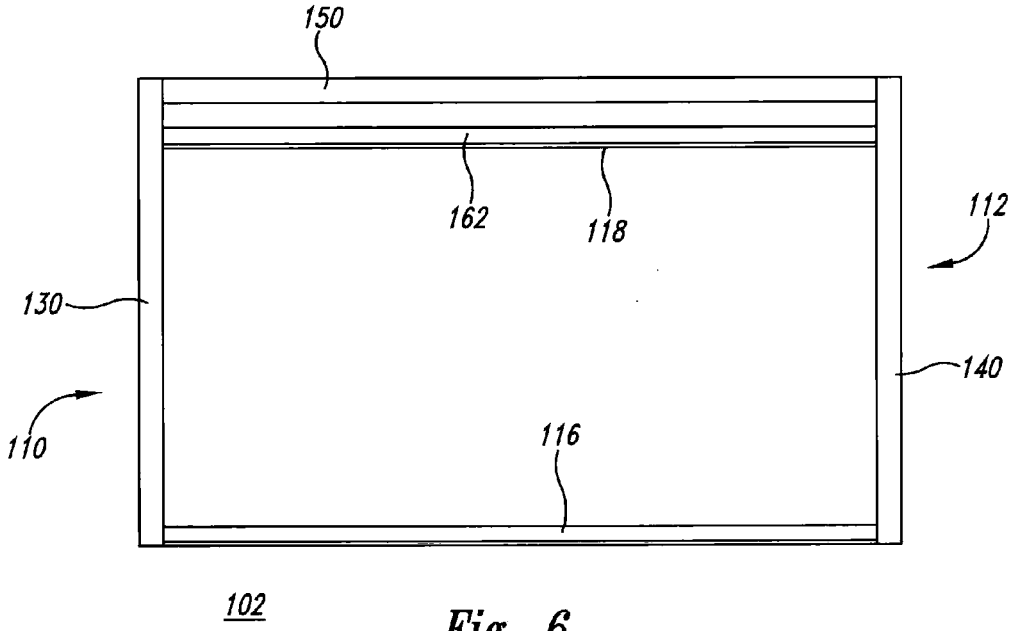
FIG. 6 is a front elevation view of the frame of FIG. 3.

FIG. 6 is a front elevation view of the frame portion 102 when the furniture system 100 is in the table configuration. The frame portion 102 of the furniture system 100 is simply rotated 90° in order to change from the chair configuration (see FIG. 1) to the table configuration (see FIG. 2). For this reason, those skilled in the art will immediately recognize that FIG. 5 is a top view of the frame portion 102 when the furniture system 100 is placed in the table configuration. However, FIG. 5 is also the back elevation view of the frame portion 102 when the furniture system 100 is placed in the chair configuration. Similarly, FIG. 6 is a front elevation view of the frame portion 102 when the furniture system 100 is placed in the table configuration. However, FIG. 6 is also the top plan view of the frame portion 102 when the furniture system 100 is in the chair configuration.

Figure 7:
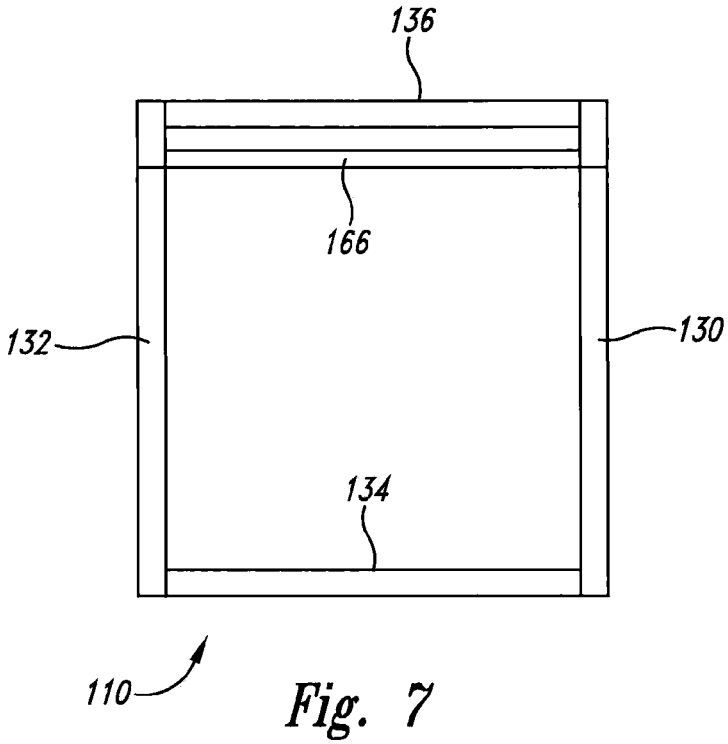
FIG. 7 is a left-side elevation view of the frame of FIG. 3.

FIG. 7 is a left-side elevation view of the frame portion 102 when the furniture system 100 is in the table configuration. Rotating the image of FIG. 7 counterclockwise by 90° provides a left-side elevation view of the frame portion 102 when the furniture system 100 is used in the chair configuration.

Figure 8:
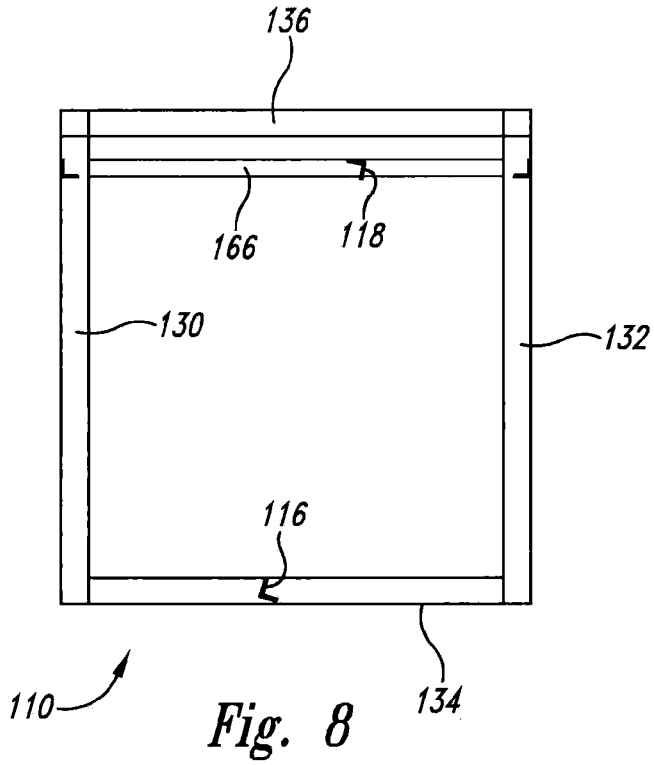
FIG. 8 is a cross-section view of the frame of FIG. 3.

FIG. 8 is a cross-section view of the frame portion 102 when viewed from the right side. The image in FIG. 8 may be rotated clockwise by 90° to illustrate the positioning of the frame portion 102 when the furniture system 100 is used in the chair configuration. In this configuration, it may be readily seen that the cross-members 116 and 118 are mounted at angles to accommodate the angle of the seat bottom 122 (see FIG. 1) when the furniture system 100 is used in the chair configuration. When in the chair configuration, one edge of the seat bottom 122 rests along its entire length within the bracket of the cross-member 118 and is fully supported along one edge by the cross-member. The opposite edge of the seat bottom 122 rests along a top edge of the cross-member 116 and is fully supported along its length by the cross-member 116. Thus, the seat bottom 122 is fully supported along its length by the cross-members 116 and 118 when the furniture system 100 is in the chair configuration.

Figure 9:
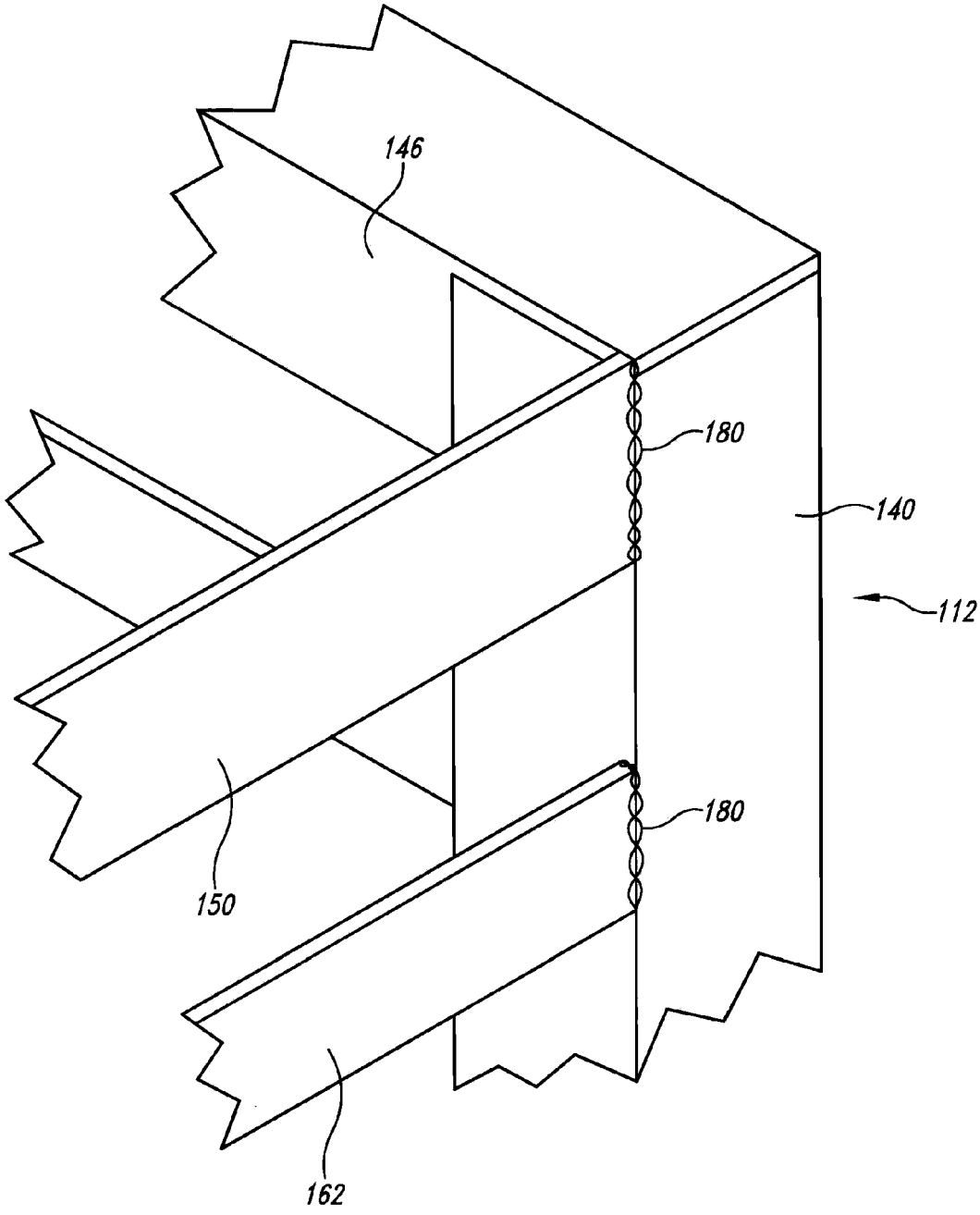
FIG. 9 is an exploded perspective view illustrating construction techniques for the frame of FIG. 3.

FIGS. 9-12 illustrate different forms of connection between the various components of the frame portion 102. In one embodiment, illustrated in FIGS. 9 and 10, the various components of the frame portion 102 are welded together. In FIG. 9, a weld 180 is used to interconnect the first support bracket member 162 to the first piece 140 of the right-side portion 112. Similarly, the first support member 150 is coupled to the first piece 140 of the right-side portion 112 by the weld 180. In the illustration of FIG. 9, the welds 180 are made on the outside of the frame portion 102. Those skilled in the art will recognize that welds may be made on the inside of the frame portion 102 in addition to the welds on the outside or in place of the welds on the outside.

Figure 10:
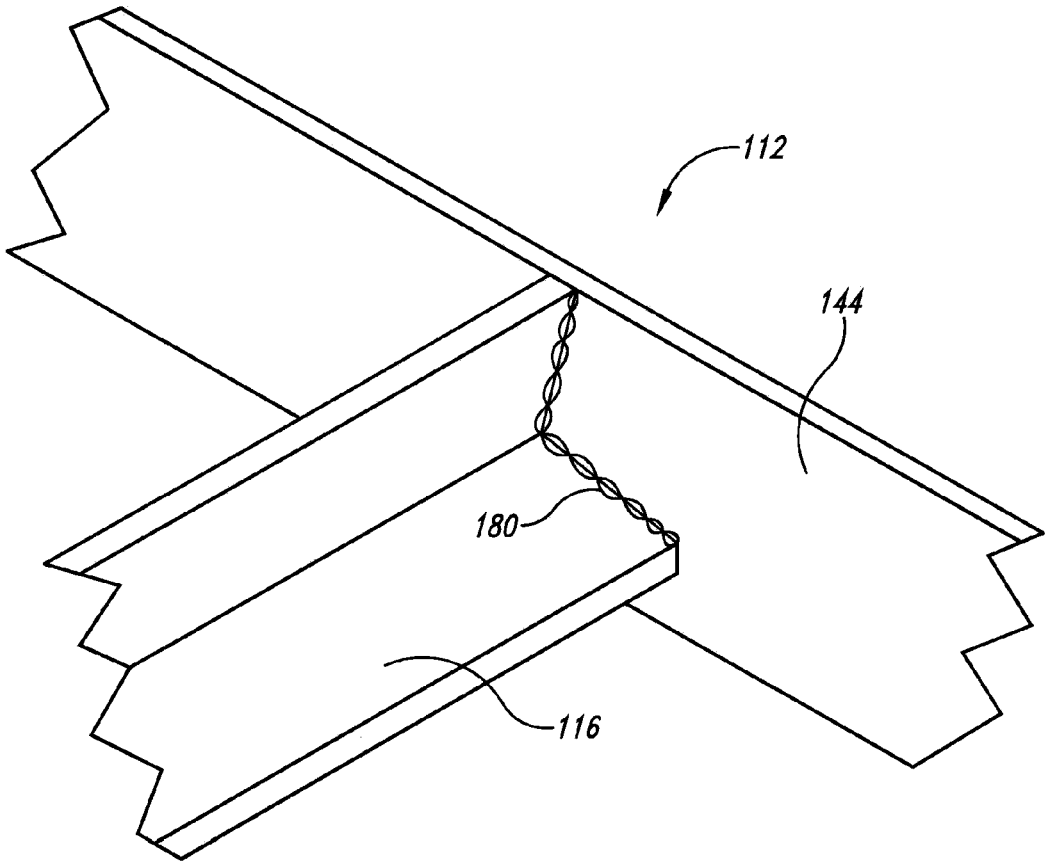
FIG. 10 is an exploded perspective view illustrating construction techniques for the frame of FIG. 3.

Similarly, FIG. 10 illustrates the connection of the cross-member 116 to the third piece 144 of the right-side portion 112 using welds 180. The advantage of welding is low cost, ease of construction, and strength and rigidity of the frame portion 102. However, assembly of the frame portion 102 using welds 180 makes the furniture system 100 more difficult to ship. Accordingly, other commercial embodiments may use different connection techniques for joining together the components of the frame portion 102.

Figure 11:
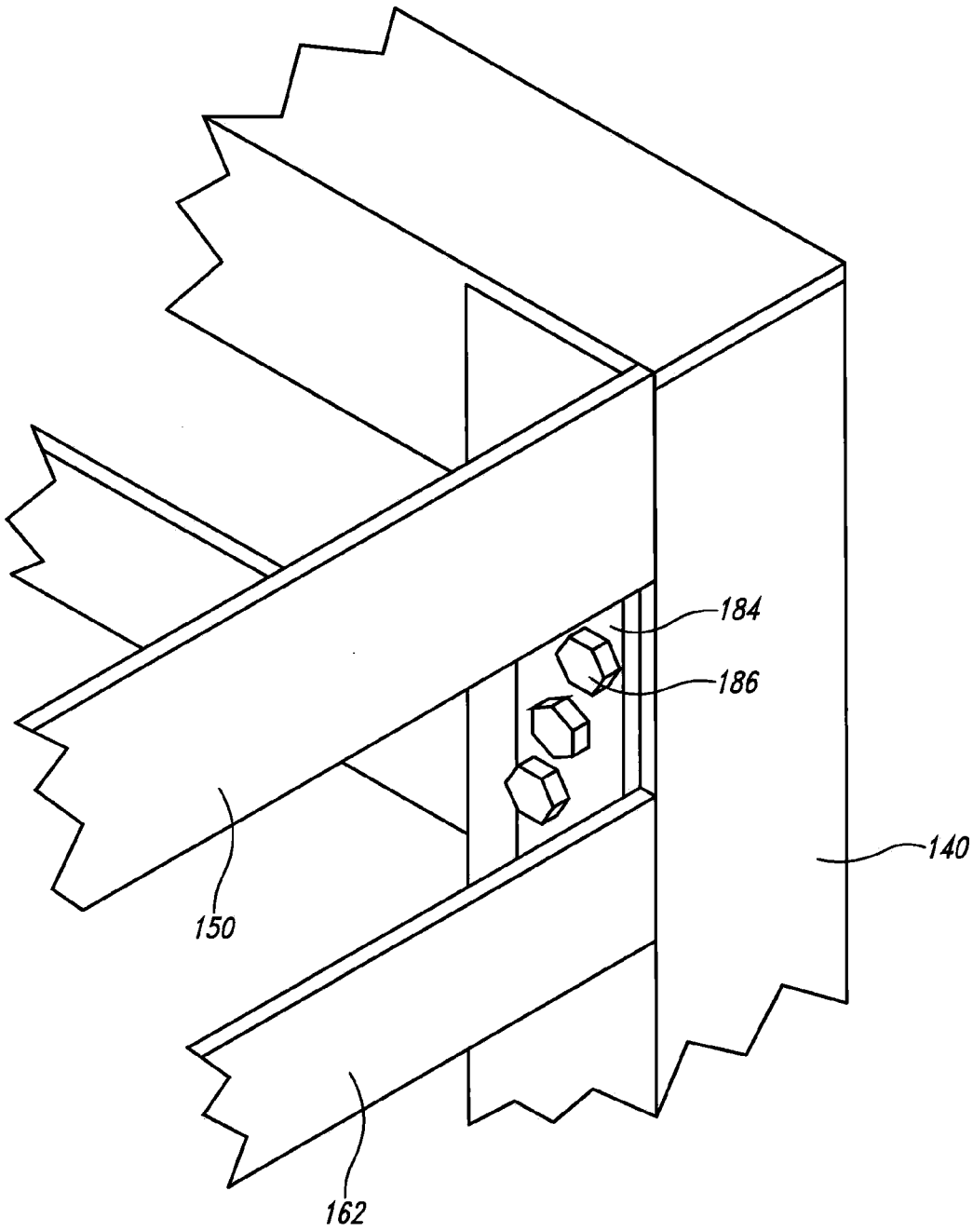
FIG. 11 is an exploded perspective view illustrating an alternative construction technique for the frame of FIG. 3.
Figure 12:
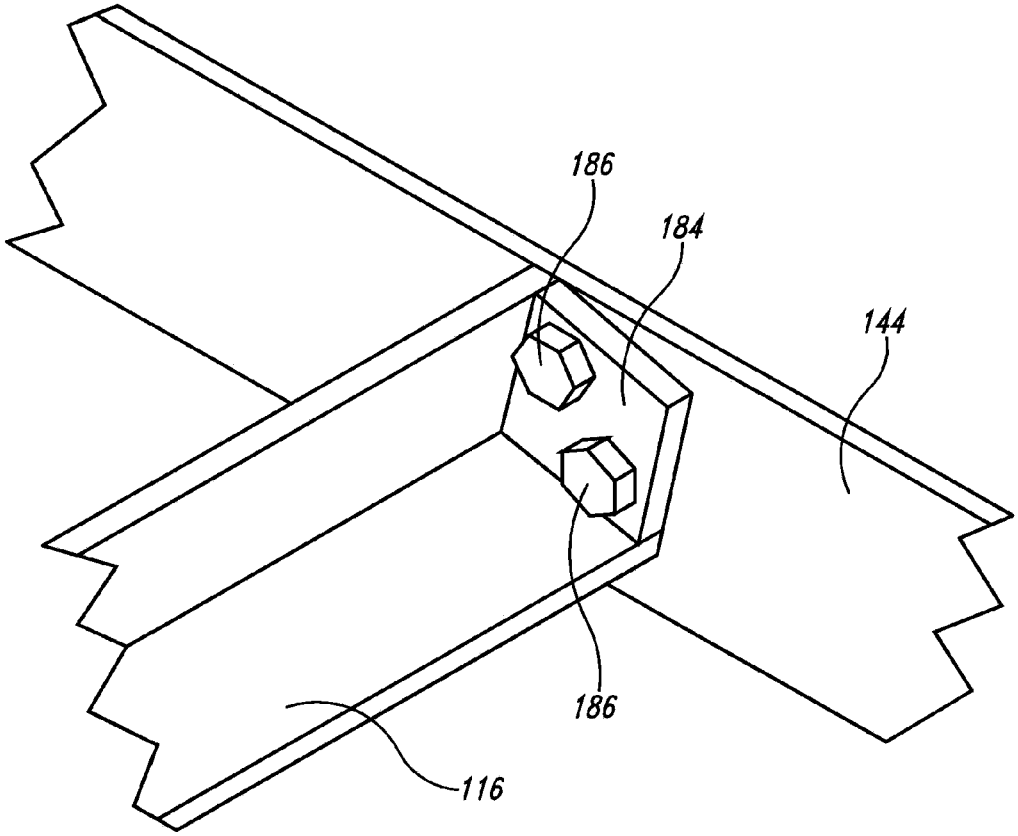
FIG. 12 is an exploded perspective view illustrating an alternative construction technique for the frame of FIG. 3.

One such alternative embodiment is illustrated in FIGS. 11-12. In FIG. 11, a bolt plate 184 is welded to the first support bracket member 162 and the first support member 150. Bolts 186 pass through holes (not shown) in the bolt plate 184 and in the first piece 140 of the right-side portion 112 to screw into nuts (not shown) in a conventional fashion. The nuts may be welded to the first piece 140 of the right-side portion 112 or may be unattached.

Similarly, a bolt plate 184 is welded to the cross-member 116, as illustrated in FIG. 12. Bolts 186 pass through holes (not shown) in the bolt plate 184 and the fourth piece 144 of the right-side portion 112 for connection with nuts. In this manner, the components of the frame portion 102 may be shipped in a disassembled form and assembled on location. This alternative embodiment also provides greater flexibility in dismantling the frame portion for subsequent shipping to a new location. Other alternative connectors, known in the art, may also be used to connect the components of the frame portion 102. The present invention is intended to embody all such connector types.

Thus, the furniture system 100 allows great flexibility in interconverting between a chair configuration and a table configuration simply by temporarily removing the working surface portion 104 and rotating the frame portion 102 90°. After rotation of the frame portion 102, the working surface portions are reinstalled at new locations to alter the configuration of the furniture system 100 and to thereby serve a new function in a new configuration.

Figure 13:
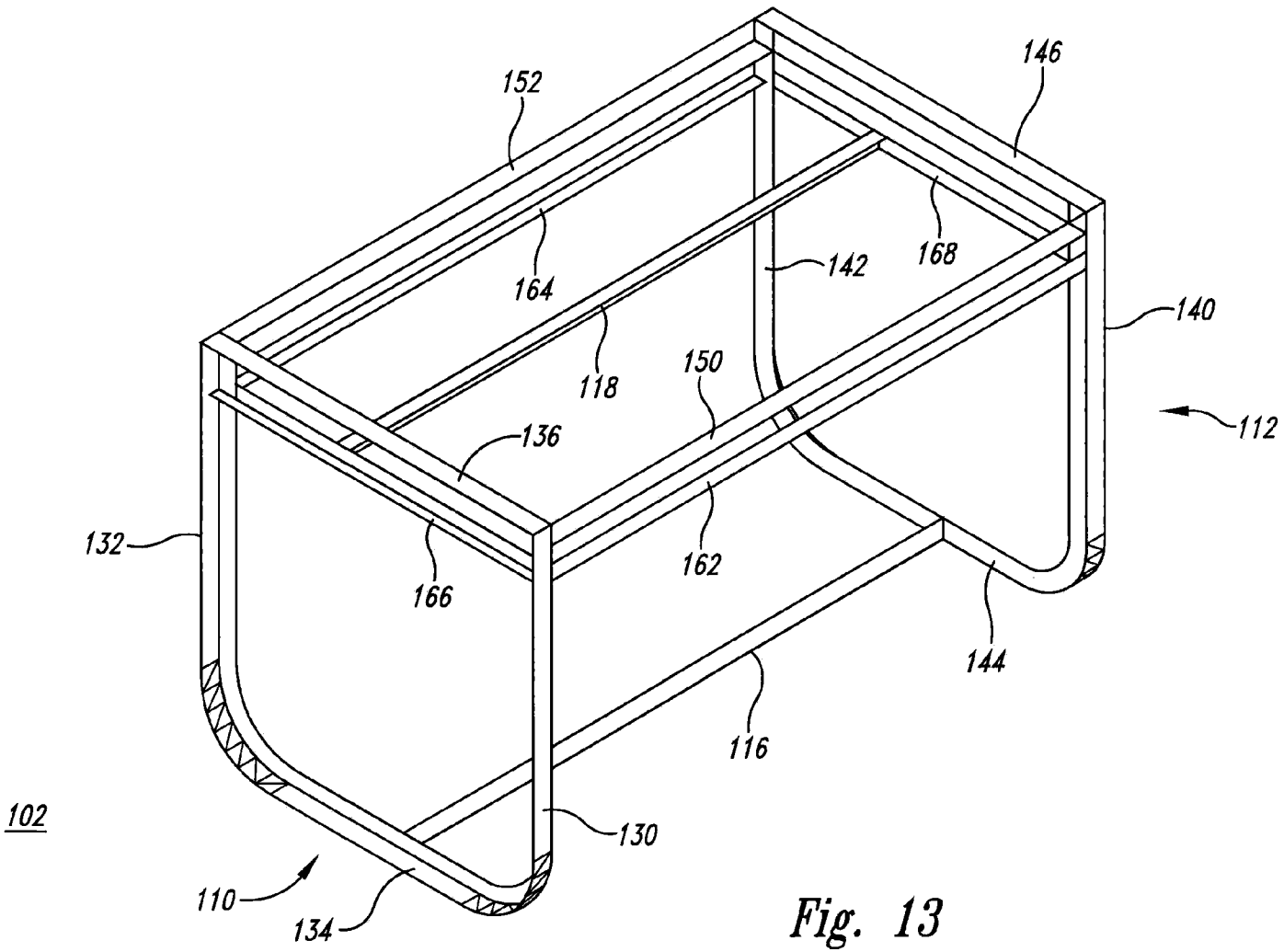
FIG. 13 is a perspective view of an alternative embodiment of the furniture system in a table configuration with the working surface removed.
Figure 14:
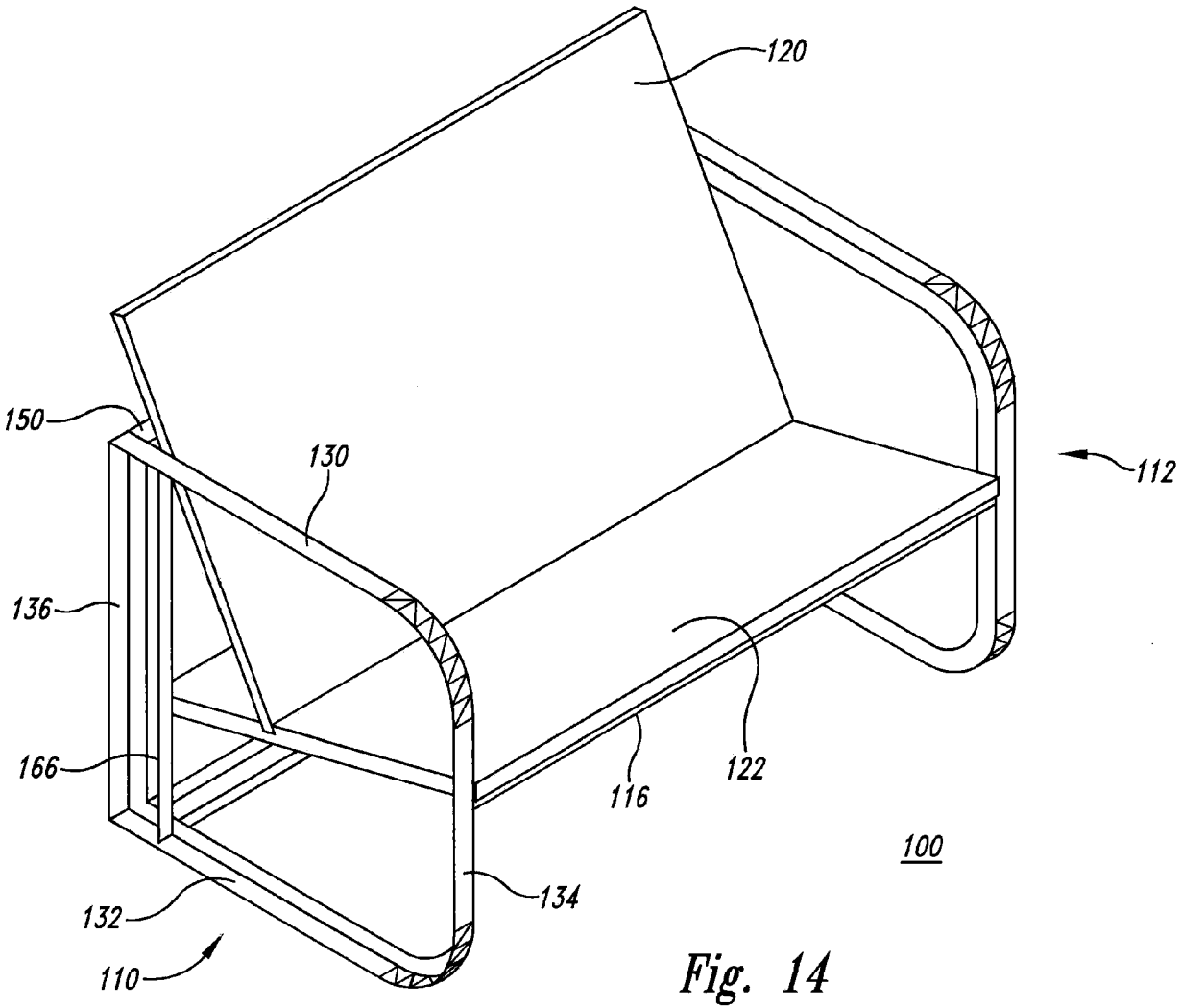
FIG. 14 is a perspective view of the alternative embodiment of FIG. 13 in a chair configuration.

Those skilled in the art will recognize that a variety of alternative implementations may be used to implement the furniture system 100. As previously discussed, the frame portion 102 may be implemented using a variety of materials and a variety of different techniques to interconnect the frame portion components. For example, connection of the frame member components can be varied. The connection of angle brackets used to manufacture the components of the frame portion 102 illustrated in FIGS. 1-10 is one example implementation that may be easily varied. The pieces may be mitered or sizes changed but maintaining the general overall dimensions of the frame portion 102. The side frame portions 110 and 112 may also be manufactured in alternative shapes, as illustrated in FIGS. 13-14. In those figures, the left-side portion 110 is chamfered or rounded to form the first and second opposing pieces 130 and 132 and the third interconnecting piece 134. Similar techniques may be used to manufacture the right-side portion 112 of the frame portion 102. In this embodiment, the left-side portion 110 and right-side portion 112 may be manufactured from rolled steel, composite materials, wood, or the like. With these alternative embodiments, the general overall dimensions of the frame portion 102 are still maintained so as to position the working surface portion 104 at the proper height in the table configuration and to permit the seat bottom 122 to be placed at a convenient height for sitting when the furniture system 100 is placed in the chair configuration.

Figure 15:
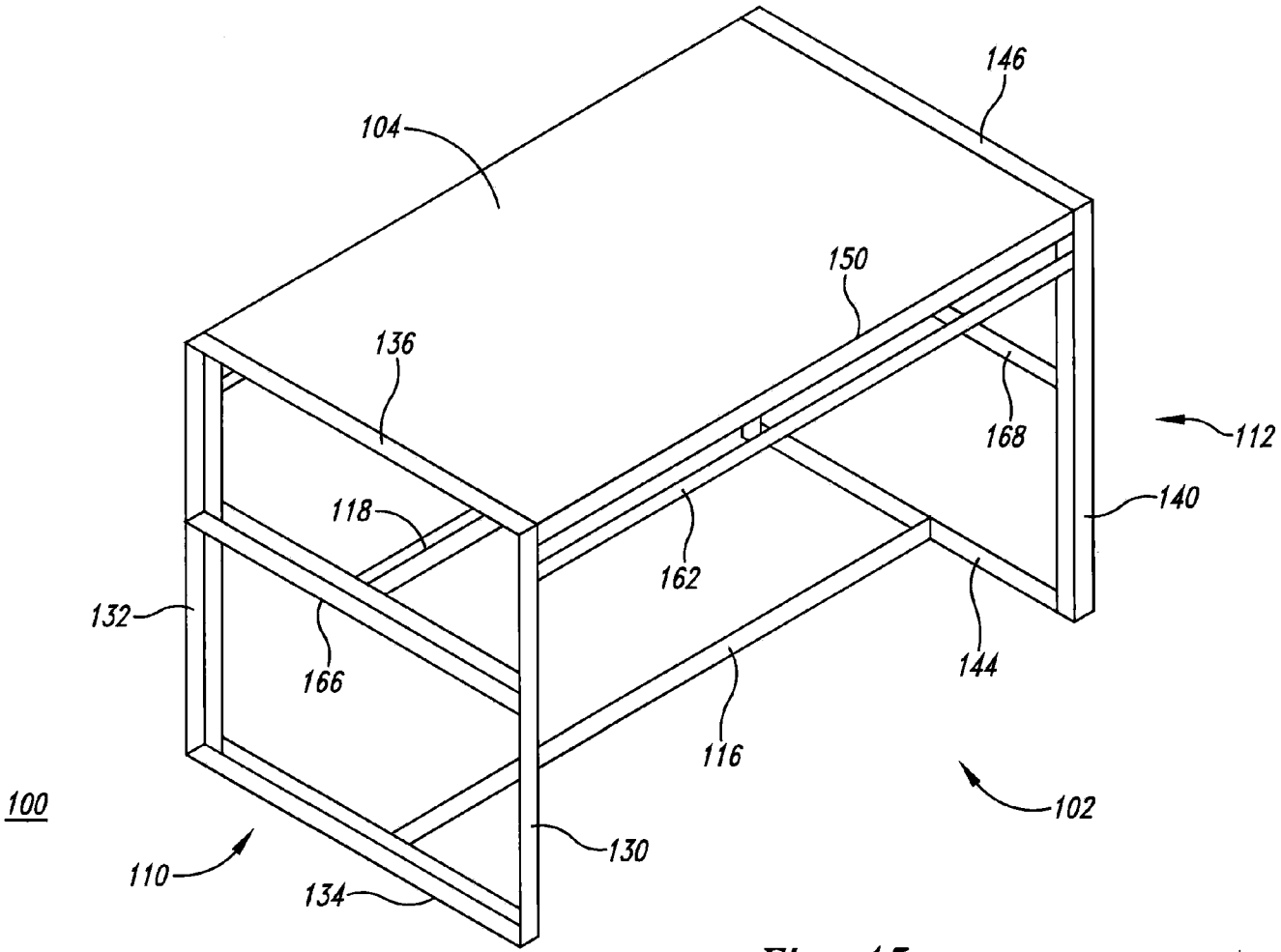
FIG. 15 is a perspective view of another alternative embodiment of the furniture system in a table configuration.
Figure 16:
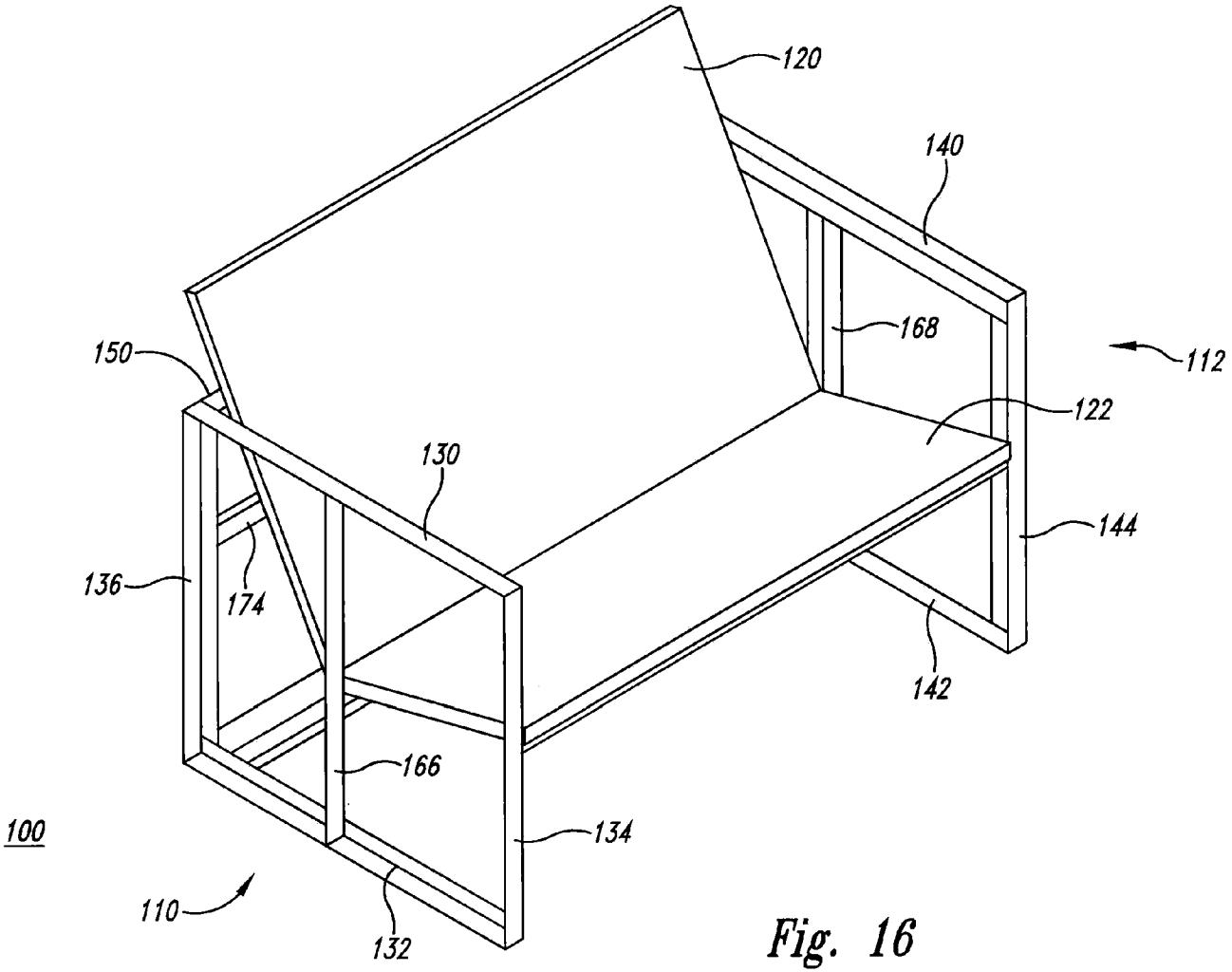
FIG. 16 is a perspective view of the alternative embodiment of FIG. 15 in a chair configuration.

Other variations in the furniture system 100 allow alternative implementations. FIGS. 15-16 illustrate another alternative embodiment of the furniture system 100. In FIGS. 15 and 16, the third support bracket member 166 of the left-side portion 110 is repositioned to a location near the midpoint of the first and second opposing members 130 and 132. Similarly, the third support bracket member 168 of the right-side portion 112 is repositioned to a location near the midpoint of the first and second opposing members 140 and 142. The cross-member 118 is still coupled between the third support bracket 166 of the left-side portion 110 and the third support bracket 168 of the right-side portion 112. However, the cross-member 118 is also repositioned by virtue of the new locations for those support bracket members.

Figure 17:
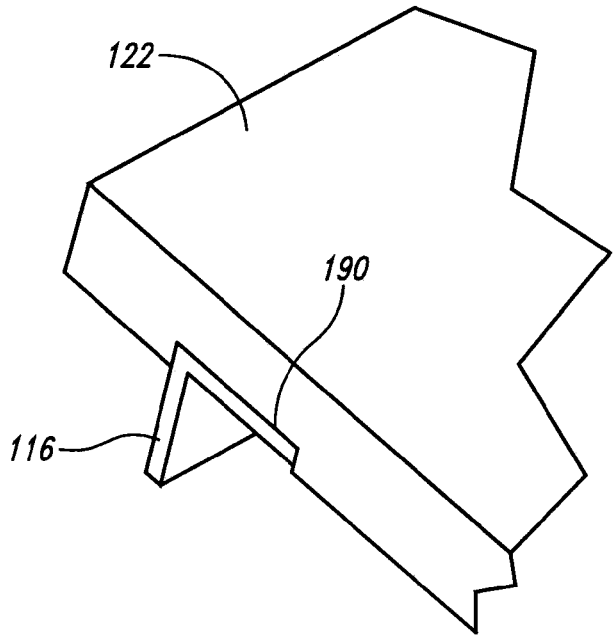
FIG. 17 is a fragmentary view of an alternative embodiment of the inventive device illustrating details of support components.

FIG. 17 illustrates an alternative method to receive and removably retain the seat bottom 122. In this implementation, the seat bottom 122 includes a channel 190 sized to receive a portion of the cross-member 116, as illustrated in FIG. 17. The channel 190 may be placed in the seat bottom using a router, milling machine or other conventional tool. The channel 190 may be used with any of the embodiments of the furniture system 100 as an alternative technique for support in the seat bottom 122.

Figure 18:
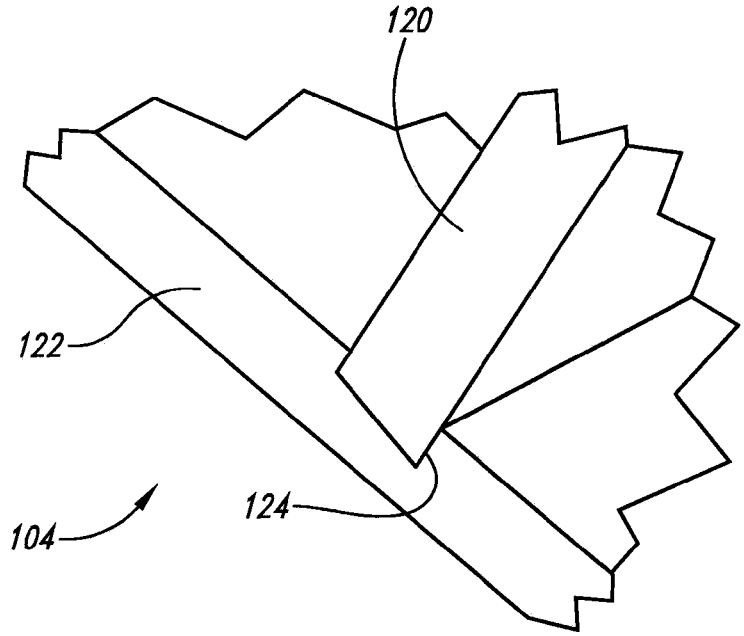
FIG. 18 is a fragmentary view of an alternative embodiment of the inventive device illustrating details of support components.

FIG. 18 illustrates an alternative shape for the channel 124 to receive and removably retain the seat back 120. In this embodiment, the channel 124 may be shaped to correspond with the angle at which the seat back 120 abuts the seat bottom 122.

Figure 19:
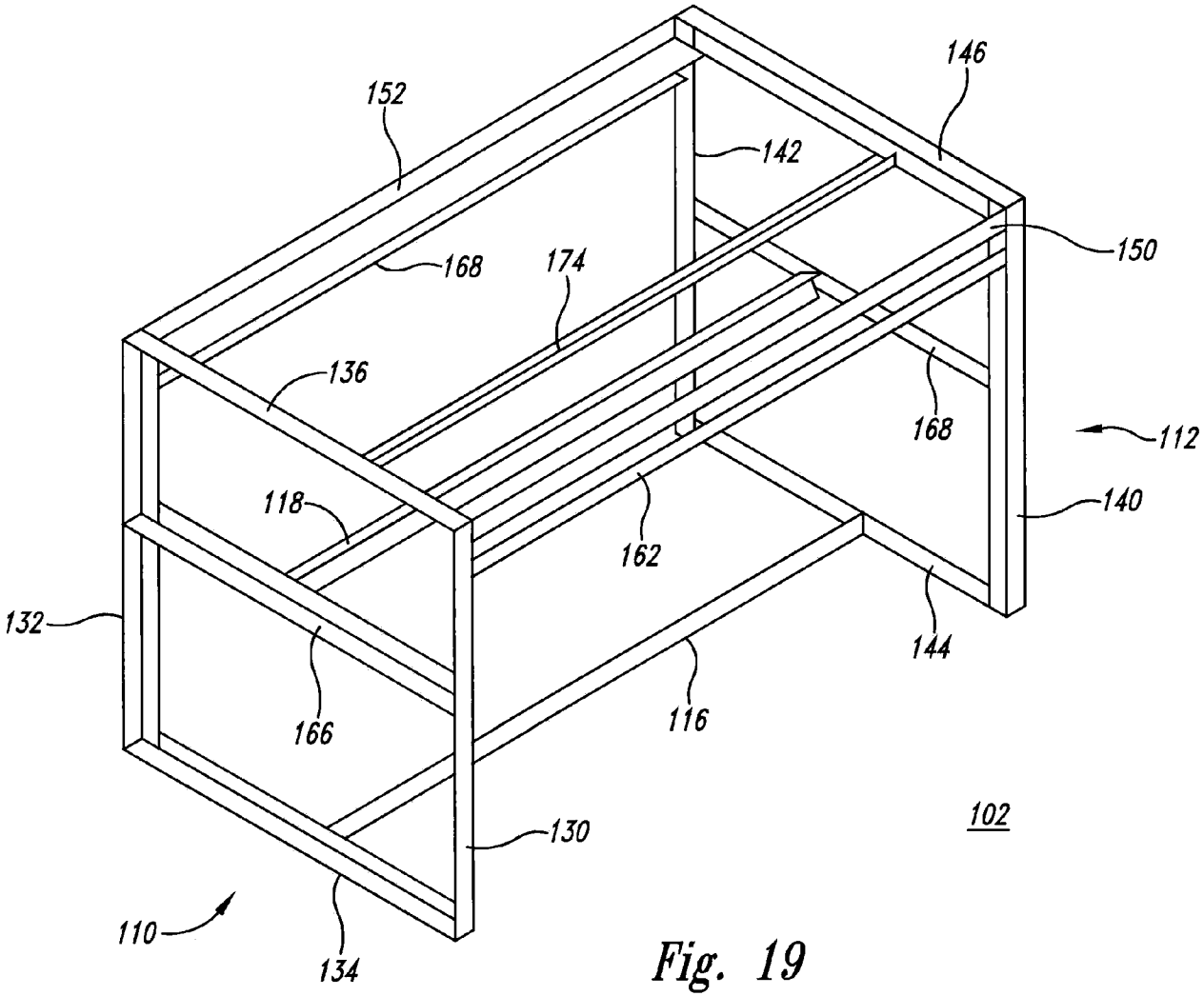
FIG. 19 is a perspective view of the embodiment of FIG. 15 in a table configuration with the working surface removed.
Figure 20:
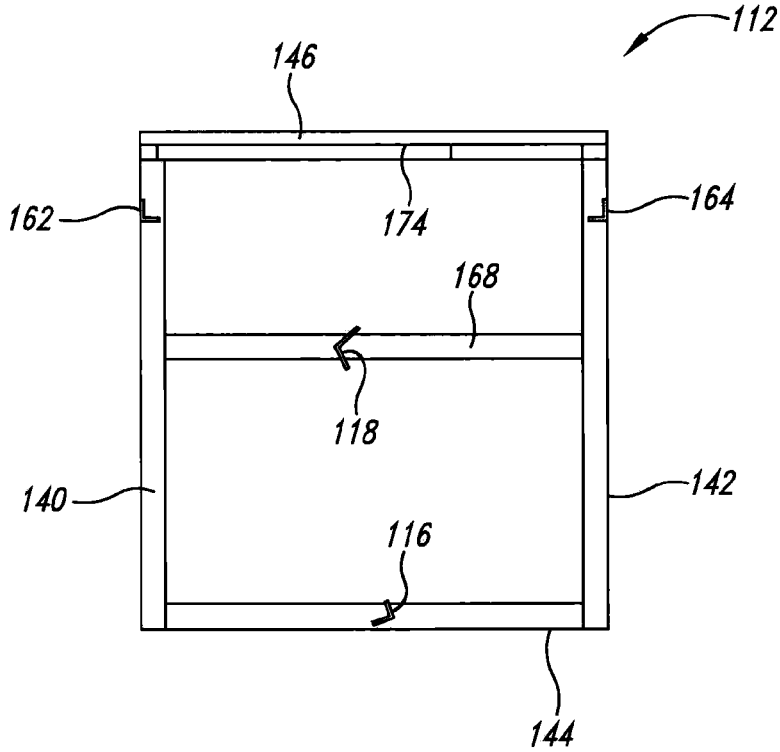
FIG. 20 is a cross-section view of the frame of FIG. 15.
Figure 21:
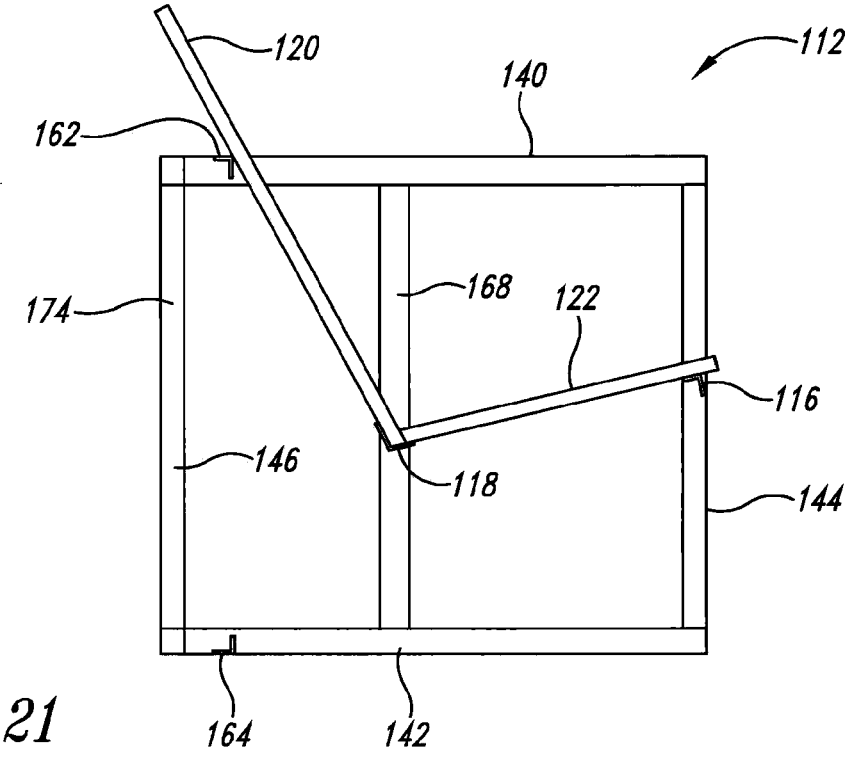
FIG. 21 is a cross-section view of the frame of FIG. 16.

FIGS. 19-21 are additional views of the alternative embodiment of FIGS. 15-16. As best illustrated in FIG. 19, an additional cross-brace 174 may be added to couple the fourth piece 136 of the left-side portion 110 to the fourth piece 146 of the right-side portion 112. The additional cross-brace 174 provides additional support for the working surface portion 104 when the furniture system 100 is used in the table configuration.

Figure 22:
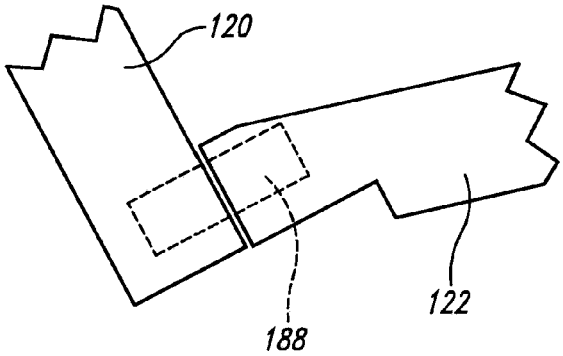
FIG. 22 is a fragmentary view illustrating a hinge system for the inventive furniture system with the hinge in a closed position.
Figure 23:
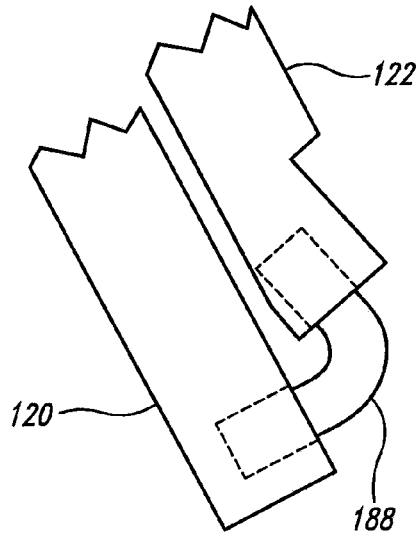
FIG. 23 is a fragmentary view illustrating the hinge system of FIG. 22 with the hinge in an open position.

In certain embodiments, the seat back 120 and seat bottom 122 are implemented as separate pieces. However, the seat back 120 and seat bottom 122 may be coupled together. FIGS. 22-25 illustrate two alternative embodiments for implementing the working surface portion 104. In FIGS. 22 and 23, the seat back 120 and seat bottom 122 are coupled together using a Soss hinge 188. In FIG. 22, the Soss hinge 188 is illustrated in a closed position to permit the seat back 120 and seat bottom 122 to be used in the chair configuration.

FIG. 23 illustrates the Soss hinge 188 in an open position, as would be used when the furniture system 100 is placed in the table configuration. Although the Soss hinge 188 is only illustrated diagrammatically, the hinge permits the seat back 120 and the seat bottom 122 to lie flat against each other for use as a table surface when the furniture system 100 is used in the table configuration.

Figure 24:
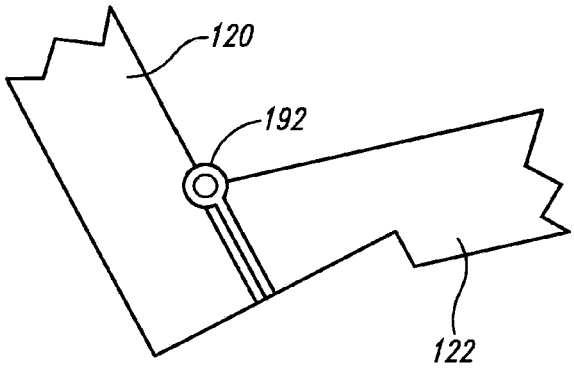
FIG. 24 is a fragmentary view illustrating an alternative hinge system for the inventive furniture system with the hinge in a closed position.
Figure 25:
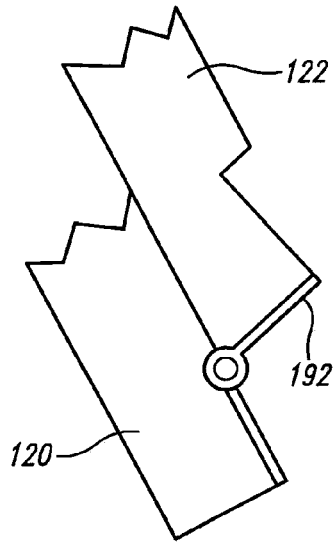
FIG. 25 is a fragmentary view illustrating the alternative hinge system of FIG. 24 with the hinge in a closed position.

In another alternative embodiment, illustrated in FIGS. 24-25, the seat back 120 and the seat bottom 122 are coupled together by a piano hinge 192. FIG. 24 illustrates the piano hinge 192 in a closed position to permit the seat back 120 and seat bottom 122 to be used in a chair configuration.

FIG. 25 illustrates the piano hinge 192 in an open position to permit the seat back 120 and seat bottom 122 to be used in the table configuration. The piano hinge 192 allows the seat back 120 and seat bottom 122 to lie flat against each other for use as the working surface portion 104 when the furniture system 100 is used in the table configuration.

Those skilled in the art will recognize that other various connection mechanisms may be used to interconnect the seat back 120 and seat bottom 122. In addition, other configurations of the frame portion 102 may be readily implemented to permit the furniture system 100 to interconvert between a table configuration and a chair configuration.

The foregoing described embodiments depict different components contained within, or connected with, different other components. It is to be understood that such depicted architectures are merely exemplary, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected", or "operably coupled", to each other to achieve the desired functionality.

While particular embodiments of the present invention have been shown and described, it will be obvious to those skilled in the art that, based upon the teachings herein, changes and modifications may be made without departing from this invention and its broader aspects and, therefore, the appended claims are to encompass within their scope all such changes and modifications as are within the true spirit and scope of this invention. Furthermore, it is to be understood that the invention is solely defined by the appended claims. It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to inventions containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations).

The invention claimed is:

1. A reconfigurable furniture system resting on a support surface, comprising:

a first side frame having first and second opposing portions and third and fourth opposing portions, the first opposing portion being coupled to a first end of the third portion and a first end of the fourth portion, the second opposing portion being coupled to a second end of the third portion and a second end of the fourth portion;

a second side frame opposing the first side frame, the second side frame portion having first and second opposing portions and third and fourth opposing portions, the first opposing portion of the second side frame being coupled to a first end of the third portion of second side frame and a first end of the fourth portion of second side frame, the second opposing portion of second side frame being coupled to a second end of the third portion of second side frame and a second end of the fourth portion of second side frame;

a first support member being coupled to the first portion of the first side frame proximate the fourth portion of the first side frame and to the first portion of the second side frame proximate the fourth portion of the second side frame;

a second support member being coupled to the second portion of the first side frame proximate the fourth portion of the first side frame and to the second portion of the second side frame proximate the fourth portion of the second side frame;

a first cross-member coupling the first and second side frames;

a second cross-member coupling the first and second side frames; and an operating surface member being positioned on and supported by the first and second cross-members when the furniture system is in a first configuration with the second portion of the first side frame and the second portion of the second side frame resting on the support surface in the first configuration, wherein the first configuration is a seat configuration and the operating surface member comprises first and second operating surface portions, the first operating surface portion being positioned to function as a seat bottom and the second operating surface portion being configured to function as a seat back; and a retaining member on the first operating surface portion to receive and releasably retain the second operating surface portion, the operating surface member being positioned proximate and supported by the first and second support members when the furniture system is in the second configuration with the third portion of the first side frame and the third portion of the second side frame resting on the support surface in the second configuration, whereby the entire operating surface member is maintained in a substantially planar arrangement when the furniture system is in the second configuration.

2. The system of claim 1 wherein the second portions of the first and second side frames are positioned to rest on a floor surface.

3. The system of claim 1 wherein the first portions of the first and second side frames are positioned at opposite sides of the operating surface and project outwardly from the first support member to serve as first and second arm rests, respectively.

4. The system of claim 1 wherein the retaining member on the first operating surface portion comprises a channel having sufficient depth to receive and releasably retain the second operating surface portion.

5. The system of claim 1, further comprising a hinge to couple the first and second operating surface portions.

6. The system of claim 1 wherein the second configuration is a table configuration and the operating surface member is positioned to function as a table top.

7. The system of claim 6 wherein the third portions of the first and second side frames are positioned to rest on a floor surface.

8. The system of claim 1 wherein the first and second side frames, the first and second support members and the first and second cross-members are made from metal.

9. The system of claim 1 wherein the first and second support members and the first and second cross-members are coupled to the first and second side frames by welding.

10. The system of claim 1 wherein the first and second support members and the first and second cross-members are removably coupled to the first and second side frames.

11. The system of claim 10 wherein the first and second support members and the first and second cross-members are coupled to the first and second side frames by bolts.

12. A reconfigurable furniture system comprising:

first and second opposing side frames each having first and second sets of side frame members, the first set of side frame members providing vertical support when the furniture system is placed in a first configuration and the second set of side frame members providing vertical support when the furniture system is placed in a second configuration;

first and second support members coupled to the first and second side frames, the first and second support members defining a plane that is vertically oriented when the furniture system is placed in the first configuration and horizontally oriented when the furniture system is placed in a second configuration;

first and second cross-members coupled to the first and second side frames at a location spaced apart from the first and second support members;

an operating surface member resting on and supported by the first and second cross-members when the furniture system is placed in the first configuration, the operating surface member resting on and supported by the first and second support members and not being supported by either the first or second cross-members when the furniture system is placed in the second configuration;

wherein the first configuration is a seat configuration and the operating surface member is resting on and supported by the first and second cross-members to function as a seat bottom;

an additional operating surface member being positioned approximate to and supported by the first operating surface member and the first support member to function as a seat back when the furniture system is in the first configuration; and a retaining member on the first operating surface member to receive and releasably retain the second operating surface member.

13. The system of claim 12 wherein the retaining member on the first operating surface member comprises a channel having sufficient width and depth to receive and releasably retain the second operating surface member.

14. The system of claim 12, further comprising a hinge to couple the operating surface member and the additional operating surface member.

15. The system of claim 12 wherein the first set of side frame members are positioned to provide vertical support as legs when the furniture system is placed in the first configuration.

16. The system of claim 12 wherein the second configuration is a table configuration and the operating surface member is resting on and supported by the first and second support members to function as a table top when the furniture system is placed in the second configuration.

17. The system of claim 16 wherein the second set of side frame members are positioned to provide vertical support as legs when the furniture system is placed in the second configuration.

18. The system of claim 12 wherein the first and second side frames, the first and second support members and the first and second cross-members are made from metal.

19. The system of claim 12 wherein the first and second support members and the first and second cross-members are coupled to the first and second side frames by welding.

20. The system of claim 12 wherein the first and second support members and the first and second cross-members are removably coupled to the first and second side frames.

21. The system of claim 20 wherein the first and second support members and the first and second cross-members are coupled to the first and second side frames by bolts.

* * * * *